US005088404A

United States Patent [19]

MacConnell et al.

[11] Patent Number: 5,088,404

[45] Date of Patent: Feb. 18, 1992

[54] DELIVERY APPARATUS FOR PRINTING PRESS

[76] Inventors: Edward P. MacConnell, 2308 Woodcliff Ct., Arlington, Tex. 76012; Shigeki Matsukawa, 2807 Cripple Creek, Grapevine, Tex. 76051

[21] Appl. No.: 349,446

[22] Filed: May 9, 1989

[51] Int. Cl.[5] ..... B41F 13/24

[52] U.S. Cl. ..... 101/232; 101/246; 101/409; 271/204

[58] Field of Search ..... 101/231, 232, 246, 409, 101/230, 420; 271/204, 82

[56] References Cited

U.S. PATENT DOCUMENTS

| | | | |
|---|---|---|---|
| 615,906 | 12/1898 | Richardson | 51/364 |
| 2,555,319 | 6/1951 | Cross | 101/230 |
| 3,370,533 | 2/1968 | Westra et al. | 101/409 |
| 3,442,506 | 5/1969 | Pasquinelli | 271/85 |
| 4,202,268 | 5/1980 | Becker | 101/232 |
| 4,409,894 | 10/1983 | Fischer | 101/420 |
| 4,690,054 | 9/1987 | Cappel et al. | 101/409 |

OTHER PUBLICATIONS

Advertising circular "Ink-Smear Preventive Film, ICP Film", Shinoda & Co., Ltd.

*Primary Examiner*—Edgar S. Burr
*Assistant Examiner*—Christopher A. Bennett
*Attorney, Agent, or Firm*—Geoffrey A. Mantooth

[57] ABSTRACT

A delivery apparatus which minimizes marring of wet ink is provided with an arcuate main wall and a gap forming leading and trailing edges. The leading edge can be positioned, either temporarily for adjustable versions, or permanently for nonadjustable versions, radially inward to shorten the path of a sheet exiting the last set of blanket and impression cylinders in a printing press. By shortening the sheet path, marring of wet ink against the delivery apparatus is reduced. The delivery apparatus is mounted onto a gripper bar sprocket shaft such that the gap receives the respective gripper bar. As the shaft rotates to move the gripper bar, the delivery apparatus also rotates. The outside surface of the delivery apparatus has a myriad of minute projections with rounded outer ends and being of a uniform height, which outer surface contact the wet ink side of the sheet.

16 Claims, 6 Drawing Sheets

DELIVERY APPARATUS FOR PRINTING PRESS

FIELD OF THE INVENTION

The present invention relates to delivery apparatuses in sheet-fed lithographic printing presses, including perfecting presses which can print on both sides of a sheet of paper.

BACKGROUND OF THE INVENTION

Sheet-fed lithographic printing presses have an infeed section, a printing section, and a delivery section. The infeed section takes individual sheets of paper from a stack of paper and delivers the sheets to the printing section. The printing section has plural rollers or cylinders, the ultimate purpose of which are to apply ink in a desired pattern or impression to the sheets of paper passing therethrough. To obtain an ink impression, a sheet of paper is squeezed between an impression cylinder and a blanket cylinder. The blanket cylinder applies wet ink to the sheet while the impression cylinder provides a hard surface for supporting the sheet during inking. As the cylinders rotate, the entire length of the sheet becomes exposed to the cylinders. Ink is applied to the blanket cylinder by plate cylinders and inking cylinders. Multicolor presses require a blanket cylinder for each color.

The delivery section removes the finished, inked sheet from the printing section and transfers it to an exit stack. The delivery section contains plural gripper bars extending transversely to the direction of sheet travel. Each gripper bar is equipped with plural grippers that grip or pinch the leading edge of a sheet as it comes out from between the last set of impression and blanket cylinders. The movement of the gripper bars are coordinated with the rotation of the impression and blanket cylinders to make the transfer of the leading edge of a sheet from the impression cylinder grippers to the gripper bar grippers. The gripper bars pull the sheets to the exit stack.

Presses using prior art delivery apparatuses have attempted to prevent or reduce the marring of wet ink. One commonly used device is known as a "skeleton" wheel in the industry. A skeleton wheel is a thin wheel positioned on a narrow nonprint area of a sheet. Because the skeleton wheel does not contact wet ink, there is no marring. Often, however, there are no nonprint areas on a sheet, the entire sheet being covered with wet ink. In this situation, skeleton wheels are useless in preventing marring. Another prior art device uses a drum covered with a netting material. This too has proven to be unsatisfactory because wet ink adheres to the netting, dries and causes marring of subsequent sheets.

Perfecting presses allow a sheet to be printed on both sides in a single run through the press. Thus, as the finished, inked sheet is brought to the delivery section of a perfecting press, both of its sides may be wet with ink, requiring care in its handling. Contact with the wet ink on one or both sides of the sheet can result in unsightly smearing or marring of the ink. Perfecting presses have problems with ink marring when the sheet contacts the last few impression cylinders. If the side of the sheet laying against the impression cylinder is wet with ink, the sheet tends to jiggle, thus destroying the registry of the sheet on the impression cylinder and causing unsightly and unintentional overlap of the various colors. In the prior art, impression cylinders have been covered with a sandpaper-like sheet material. The sheet material has a paper backing, making it unsuitable for extended use. After a period of time, the sheet material becomes dirty with ink. Cleaning is impossible, because the solvents which are required to clean the ink destroy the paper backing. Another prior art device roughens the outside surface of the impression cylinder. After a period of time, the outside surface becomes smooth, requiring reworking to roughen the surface once again, an expensive procedure.

It is an object of the present invention to provide a delivery apparatus for a sheet-fed lithographic printing press, which delivery apparatus reduces marring of wet ink.

It is a further object of the present invention to provide an apparatus for use on impression cylinders, in sheet-fed lithographic printing presses, which apparatus will reduce sheet movement of sheets having wet ink down against the impression cylinder.

DESCRIPTION OF PREFERRED EMBODIMENTS

Figure 1:
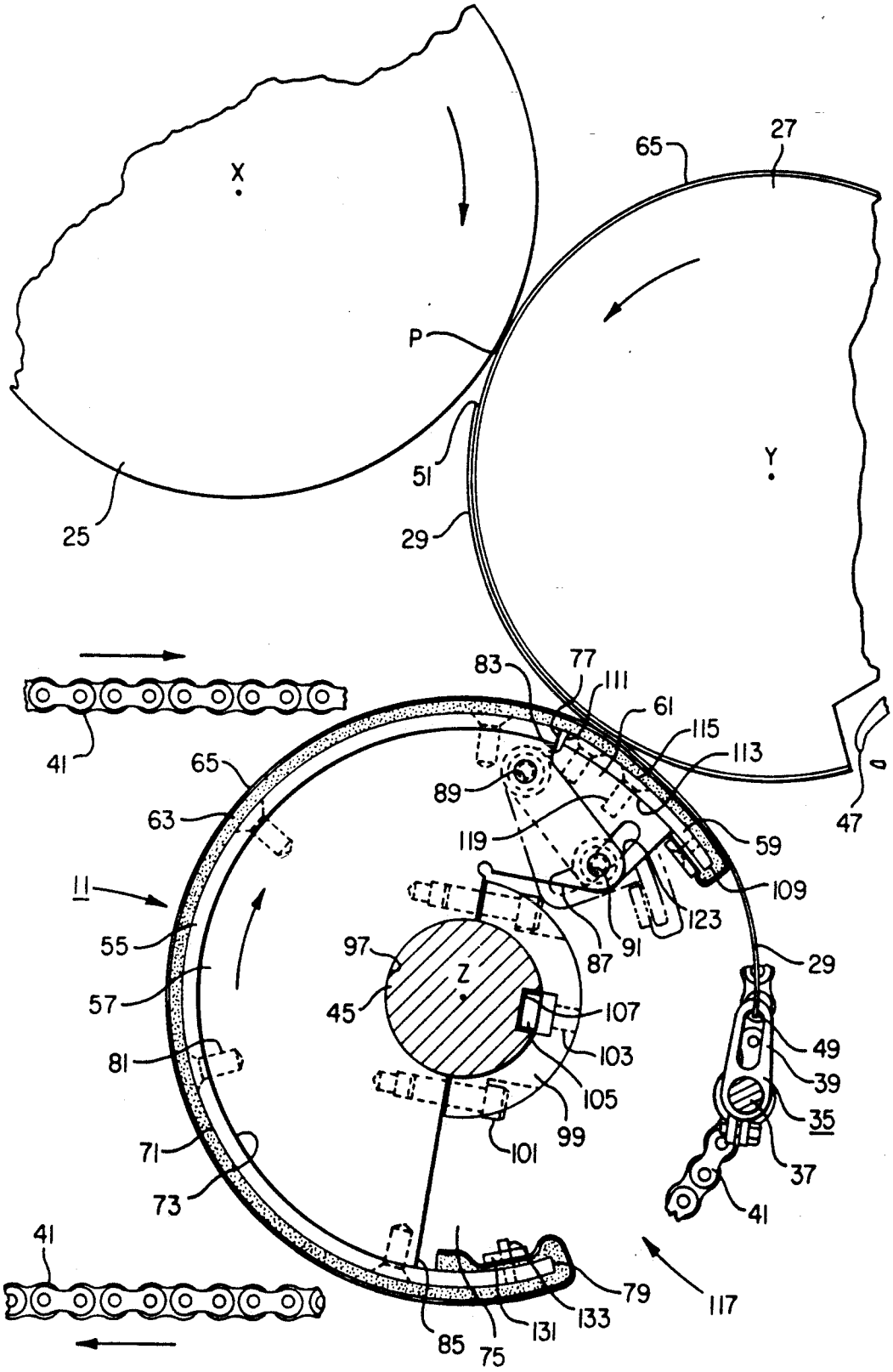
FIG. 1 is a schematic side view of the delivery end of a printing press, showing an end of the delivery apparatus of the present invention, in accordance with a preferred embodiment, wherein the leading edge wall is in the outermost position and the press has a short sheet of paper.
Figure 2:
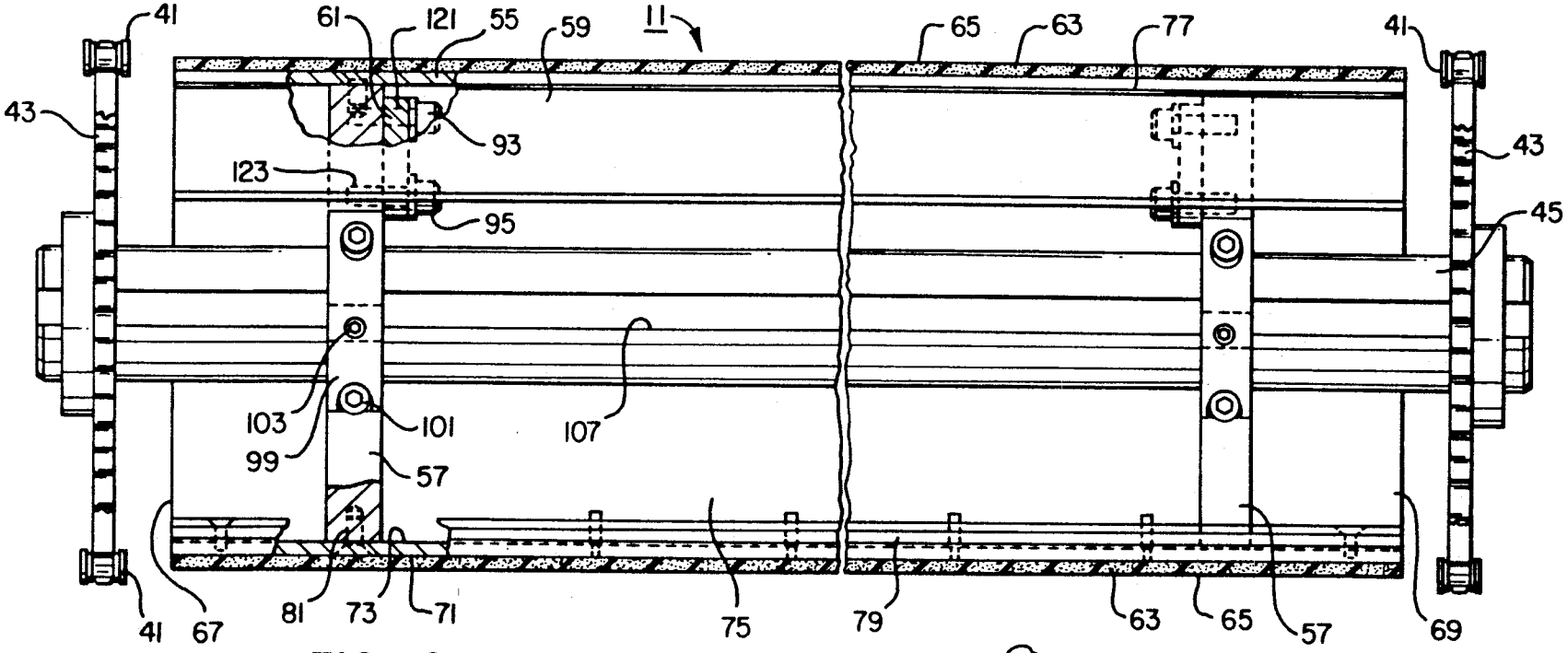
FIG. 2 is a schematic partial cross-sectional side view of the delivery apparatus of FIG. 1, showing the leading edge wall and not showing the gripper bar.

In FIGS. 1 and 2, there is shown the delivery apparatus 11 of the present invention, in accordance with a preferred embodiment. The delivery apparatus is used at the exit end of a sheet-fed offset lithographic printing press 13, such as is shown schematically in FIG. 7.

Figure 7:
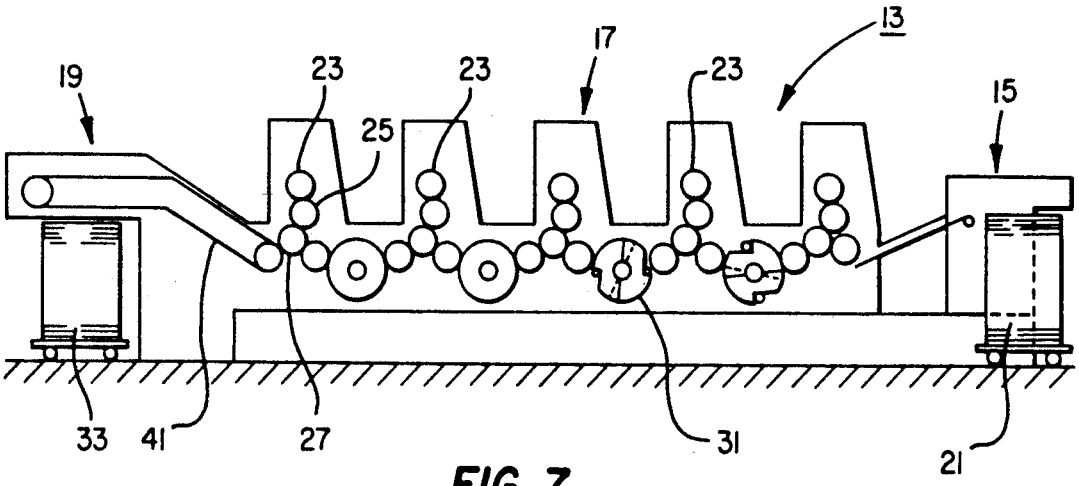
FIG. 7 is a schematic side view of a perfecting printing press.

Referring to FIGS. 1 and 7, the printing press 13 has a infeed section 15, a printing section 17, and a delivery or exit section 19. The infeed section 15 takes individual sheets of paper from a stack of paper 21 and brings the sheets to the printing section 17. The printing section 17 has plural inking means 23, with each inking means including a blanket cylinder 25 and an impression cylinder 27. Individual sheets 29 of paper travel between the blanket and impression cylinders 25, 27. The blanket cylinder 25 applies ink to one side of a sheet 29 of paper in a desired pattern. The impression cylinder 27 provides a hard surface for the blanket cylinder 25 to press the sheet 29 against. Each inking means 23 applies one color of ink to one side of a sheet. Thus, for multiple color printing, the sheets must go through plural inking means 23. To print on both sides of a sheet 29, a transfer cylinder arrangement 31 is used to effectively flip the sheet over, thus exposing its second side to subsequent blanket cylinders 25. After going through the perfecting transfer cylinder arrangement 31, the sheet then goes through additional inking means 23 that apply ink to the second side of the sheet.

After going through all of the inking means 23, the sheet exits the printing section 17 of the press by way of the delivery section 19. The delivery section removes the finished, inked sheet from the last inking means and transfer the sheet to an exit stack 33 of paper.

Referring to FIGS. 1, 2, and 7, the delivery section 19 includes plural gripper bars 35 (only one of which is shown in FIG. 1). Each gripper bar 35 includes a mounting bar 37 and plural grippers 39 mounted onto the mounting bar. The mounting bar 37 is oriented parallel to the axes of rotation of the blanket and impression cylinders 25, 27, so as to be transverse to the direction of sheet movement along the sheet path. The individual grippers 39 (only one of which is shown in FIG. 1) are positioned so as to be spaced apart from each other. The ends of the mounting bar 37 are coupled to endless chains 41, which are in turn located on sprockets 43. The sprockets 43 are mounted on a shaft 45 that is parallel to the axes of rotation of the blanket and the impression cylinders 25, 27. The sprockets 43 are located adjacent to the final inking means 23 so as to be at the exit of the blanket and impression cylinders 25, 27.

Referring to the orientation shown in FIG. 1, as the press operates, the blanket cylinder 25 rotates clockwise, the impression cylinder 27 rotates counterclockwise and the gripper bars 35 move clockwise around the shaft 45 on the sprockets 43. The movement of the gripper bars 35 is coordinated with the impression cylinder 27, which has plural grippers 47 spaced along its length. At the closest point between the path traversed by the gripper bars 35 and the impression cylinder 27, the grippers 39 of the respective gripper bar are received by the spaces between the impression cylinder grippers 47. At this point, the impression cylinder grippers 47, which have had a grip on the leading edge 49 of a sheet, open up and relinquish their grip, and the gripper bar grippers 39 close to grip the leading edge of the sheet. Thus, control of the leading edge 49 of the sheet is transferred from the impression cylinder 27 to the respective gripper bar 35. The gripper bar 35 pulls the sheet 29 clockwise around the shaft 45 and to the exit stack 33, where the grippers 39 on the gripper bar open and release the sheet. The gripper bar then travels back to the impression cylinder to grip another sheet.

The delivery apparatus 11 is mounted onto the shaft 45 so as to rotate in conjunction with the gripper bars. As the sheet 29 exits from between the blanket cylinder 25 and the impression cylinder 27, the side of sheet that is wet with ink will contact the delivery apparatus 11. The grippers 39 pull the sheet 29 around the shaft 45 to the exit stack 33. The delivery apparatus 11 reduces marring of the wet ink as the sheet 29 contact the delivery apparatus by altering the path of the sheet around the shaft so as to reduce the amount of pressure with which the sheet contacts the delivery apparatus. The sheet path is altered by providing a leading edge wall and a gap for receiving the press gripper means. The leading edge wall can be positioned, either temporarily, as in the delivery apparatus shown in FIGS. 1 and 2, or permanently, as in the delivery apparatus shown in FIGS. 3 and 4, radially inward. With the leading edge wall so positioned, the path of the sheet 29 around the shaft 45 is shortened, thereby reducing the amount of pressure with which the wet ink side of the sheet contacts the delivery apparatus. In addition, the delivery apparatus is provided with a roughened outer surface in the form of a glass-beaded film, which film enhances the non-marring aspects of the delivery apparatus.

Referring to FIGS. 1 and 2, the delivery apparatus 11 includes a main wall 55, plural support members 57, a leading edge wall 59, plural leading edge support members 61, a layer of foam 63, and a layer of film 65. The leading edge wall 59 is movable relative to the main wall 55.

The delivery apparatus 11 has two ends 67, 69 and a central axis that extends between the ends. The main wall 55 is tubular and extends between the two ends 67, 69. The main wall 55, which has outside and inside surfaces 71, 73, forms a cavity 75. The main wall 55 has a gap extending between the ends so as to form a leading edge 77 and a trailing edge 79. The main wall 55 thus describes a circular arc, with outside and inside diameters, as measured from the central axis.

The support members 57 support the main wall 55 so that the main wall retains its shape. In addition, the support members 57 are used to mount the main wall 55 to the shaft 45. The cavity 75 receives the plural support members 57 which are thick plates having generally semicircular shapes. The support members 57 are oriented transversely to the central axis and are matingly received by the inside surface 73 of the main wall 55. The support members 57 are coupled to the main wall 55 by fasteners 81 that are flush with the outside surface 71 of the main wall. The support members 57 are spaced apart from one another along the length of the main wall 55. The number and spacing of support members 57 are determined according to the size of the main wall 55, which in turn is dictated by the size of the printing press. The leading edges 83 of the respective support members 57 are aligned with the leading edge 77 of the main wall 55. The trailing edges 85 of the respective support members are spaced from the trailing edge 79 of the main wall, leaving the portion of the inside surface 71 of the main wall 55 nearest to the trailing edge 79 exposed. Each support member 57 has, near its leading edge 109, a coupling portion 87 that projects circumferentially for a short distance. The coupling portion 87 couples to the leading edge support members 61, as will be explained in more detail hereinafter. The coupling portion 87 has a first hole 89 located near the leading edge 109 of the support member 57 and a second hole 91 located near the end of the projection. The first and second holes 89, 91 receive first and second bolts 93, 95. A notch 97 for receiving the shaft 45 is formed in each support member. A semicircular locking member 99 extends across the notch 97. The locking member 99 is coupled to the support member 57 by bolts 101. The locking member has a set screw 103 and a key 105 for engaging a key slot 107 on the shaft 45.

The leading edge wall 59 is an arcuate strip that extends between the two ends 67, 69 and is positioned adjacent to the leading edge 77 of the main wall 55. The leading edge wall 59 has leading and trailing edges 109, 111 and inside and outside surfaces 113, 115. The radius of the outside surface 115 is equal to the radius of the main wall outside surface 73. The trailing edge 111 of the leading edge wall 59 is positioned adjacent to the leading edge 77 of the main wall 55. The leading edge 109 of the leading edge wall 59 projects circumferentially toward the trailing edge 79 of the main wall 55. A gap 117 is formed between the leading edge 109 of the leading edge wall 59 and the trailing edge 79 of the main wall 55.

The leading edge wall 59 is coupled to the leading edge support members 61 by way of fasteners 119 that are flush with the outside surface 115 of the leading edge wall such that the leading edge support members contact the inside surface 113 of the leading edge wall 59. Each leading edge support member 61 is pivotally coupled to a respective main wall support member 57. Each leading edge support member 61 has a first hole 121 located near the trailing edge 111 of the leading edge wall 59. The leading edge support member 61 also has an arcuate slot 123 that extends somewhat perpendicularly to the leading edge wall 59. The respective first holes 89, 121 receive the first bolt 93. The slot 123 and the second hole 91 receive the second bolt 95.

The leading edge wall 59 and the leading edge support members 61 pivot with respect to the main wall 55 about the first bolt 93 between outwardmost and inwardmost positions. In the outwardmost position, the leading edge wall 59 is extended radially outward such that its outside surface 115 lies along an imaginary arcuate extension of the outside surface 71 of the main wall 55. Thus, in the outermost position, the center of the radius of the outside surface 115 of the leading edge wall 59 is concentric to the center of the outside surface 71 of the main wall 55. The trailing edge 111 of the leading edge wall 59 is located adjacent to the leading edge 77 of the main wall 55. In the inwardmost position, the leading edge wall 59 is pivoted radially inward such that the leading edge 109 is located closer to the central axis. The outwardmost and inwardmost positions are merely the extremes of the positioning of the leading edge wall 59; the leading edge wall can be positioned at some intermediate position. The exact position is maintained by tightening the second bolt 95.

The outside surfaces 73, 115 of the main wall 55 in the leading edge wall 59 are covered in their entirety by a layer of foam material 63. The foam 63, which is resilient and flexible, is secured to the outside surfaces by a suitable adhesive. In the preferred embodiment, a one-fourth inch layer of reticulated polyurethane foam is used.

Figure 5:
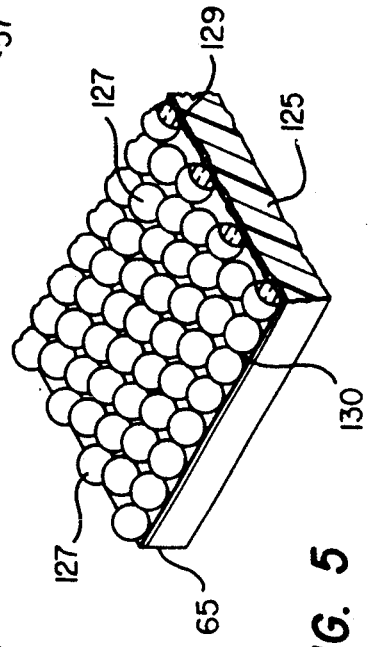
FIG. 5 is a schematic detail view of the glass-beaded film.

The outside surface of the foam 63 is covered in its entirety by a glass-beaded film 65. Referring to FIG. 5, the film 65 has a polyester substrate 125 which is of a highly uniform thickness. On one surface of the substrate 125, there are a myriad number of particles 127 bonded to the substrate with an oil resistive adhesive 129 (to resist oil based inks). It is believed that the particles 127, which are referred to herein as glass particles, can be made of either glass, silicon, silicone, or siliconized material. The glass particles 127 are spherical in shape and are of a uniform size. A single layer of glass particles 127 are bonded to the substrate with the density of glass particles being such that the glass particles typically contact the adjacent glass particles. The layer of adhesive is thin compared to the diameter of the glass particles; thus, there are voids 130 or spaces formed between the top surface of the adhesive and the points of contact between adjacent glass particles. The glass particles 127 are uniformly distributed over the substrate. The glass-beaded film is commercially available and has an overall uniform thickness (substrate plus glass particles) of 0.007 inches. Each glass particle has a diameter of 0.003 inches. The glass-beaded surface of the film has a smoothness of about RMS 125, compared to the outer surface of an impression cylinder, which typically has a smoothness of about RMS 63.

The film 65 is bonded to the foam 63 with a suitable adhesive such that the glass particles 127 face outwardly. The film 65 and the foam 63 extend to the ends 67, 69 of the walls and to the gap 117. The respective edges of the film 65 and the foam 63 are folded around the leading edge 109 of the leading edge wall 59 and around the trailing edge 79 of the mail wall 55, where they are clamped in place by clamping bars 131 extending parallel to the respective edges. The clamping bars 131 are retained to the respective walls by threaded fasteners 133.

The operation of the delivery apparatus 11 will now be described. The delivery apparatus 11 can be easily retrofitted into existing presses or installed in new presses. The delivery apparatus 11 is mounted onto the gripper bar sprocket shaft 45, between the two sprockets 43. To install, the locking members 99 are removed from the respective support member 57 and the delivery apparatus is mounted onto the shaft 45 such that the shaft is matingly received into the notches 97 of each of the support members. Then, the locking members 99 are installed onto the shaft, and coupled to the respective support members 57 by the bolts 101. The set screws 103 are tightened to set the respective keys 105 into the shaft key slot 107. Access to the bolts 101, 93, 95 and the set screw 103 is through the gap 117. When the delivery apparatus is installed onto the shaft 45, the respective gripper bars 35 are received by the gap 117 as the gripper bars go around the shaft on the sprockets 43. When the leading edge wall 59 is in the outermost position, the outside diameter of the delivery apparatus 11 is equal to the outside diameter of the impression cylinder 27. When the delivery apparatus 11 is installed on the shaft 45, the grippers 39 of the gripper bar 35 are in proximity to the leading edge 109 of the leading edge wall 59.

After the delivery apparatus 11 is installed in the press, the leading edge wall 59 is pivoted and set in the appropriate position by the press operator. The appropriate position is determined by the length of the sheets 29 which are to pass through the printing press in a print run. For short sheets 29 (see FIG. 1), the leading edge wall 59 can be in any position, but is preferably set in an outward position. For long sheets 29A, (see FIG. 1A) the leading edge wall 59 is set in an inward position.

Marring of wet ink occurs when the wet ink contacts some surface and there is a relatively large amount of force or pressure between the sheet and the surface. In the printing press, both the leading edge 49 and the trailing edge portion 51 of the sheet are retained by the printing press. The leading edge 49 of the sheet is retained by the grippers 39 of the gripper bar 35, while the trailing edge portion 51 is pinched at a pinch point (or nip) P between the blanket and impression cylinders 25, 27. As the grippers pull the sheet 29, the trailing edge 51 of the sheet will eventually be pulled free of the pinch point P. For short sheets 29, the trailing edge 51 will be pulled free soon after the grippers 39 have gripped the leading edge 49. For long sheets 29A, the trailing edge will be pulled free when the gripper bar 35 has rounded the shaft 45. Any surface that contacts the sheet 29 intermediate the grippers 39 and the pinch point P will deform the sheet and tension the sheet. Thus, the outer surface of the impression cylinder 27 causes the sheet to deflect in one direction, while the outer surface of the delivery apparatus 11 causes the sheet to deflect in the other direction, forming the sheet into an "S" shape as shown in FIG. 1. The greater the deformation of the sheet away from a straight line intersecting the pinch point P and the grippers 39, the greater the amount of force exerted by the sheet against the deforming surfaces.

In order to reduce marring of wet ink, the delivery apparatus 11 shortens the sheet path in order to reduce the deformation of the sheet and thus reduce the pressure of the sheet against the deforming surfaces. For a short sheet 29, where as shown in FIG. 1, the trailing edge portion 51 of the sheet quickly passes through the pinch point P between the blanket and impression cylinders, pressure of the sheet against the impression cylinder 27 and the delivery apparatus 11 is quickly relieved. Thus, pressure of the sheet against the delivery apparatus and the impression cylinder is short-lived. The leading edge wall 59 is typically set in the outwardmost position in order to retain some control over the sheet; it is believed that setting the leading edge wall 59 in the outermost position will prevent undue bumping of the sheet 29 against the delivery apparatus 11. However, the leading edge wall 59 could be set further inward if desired, without marring the ink.

Figure 1A:
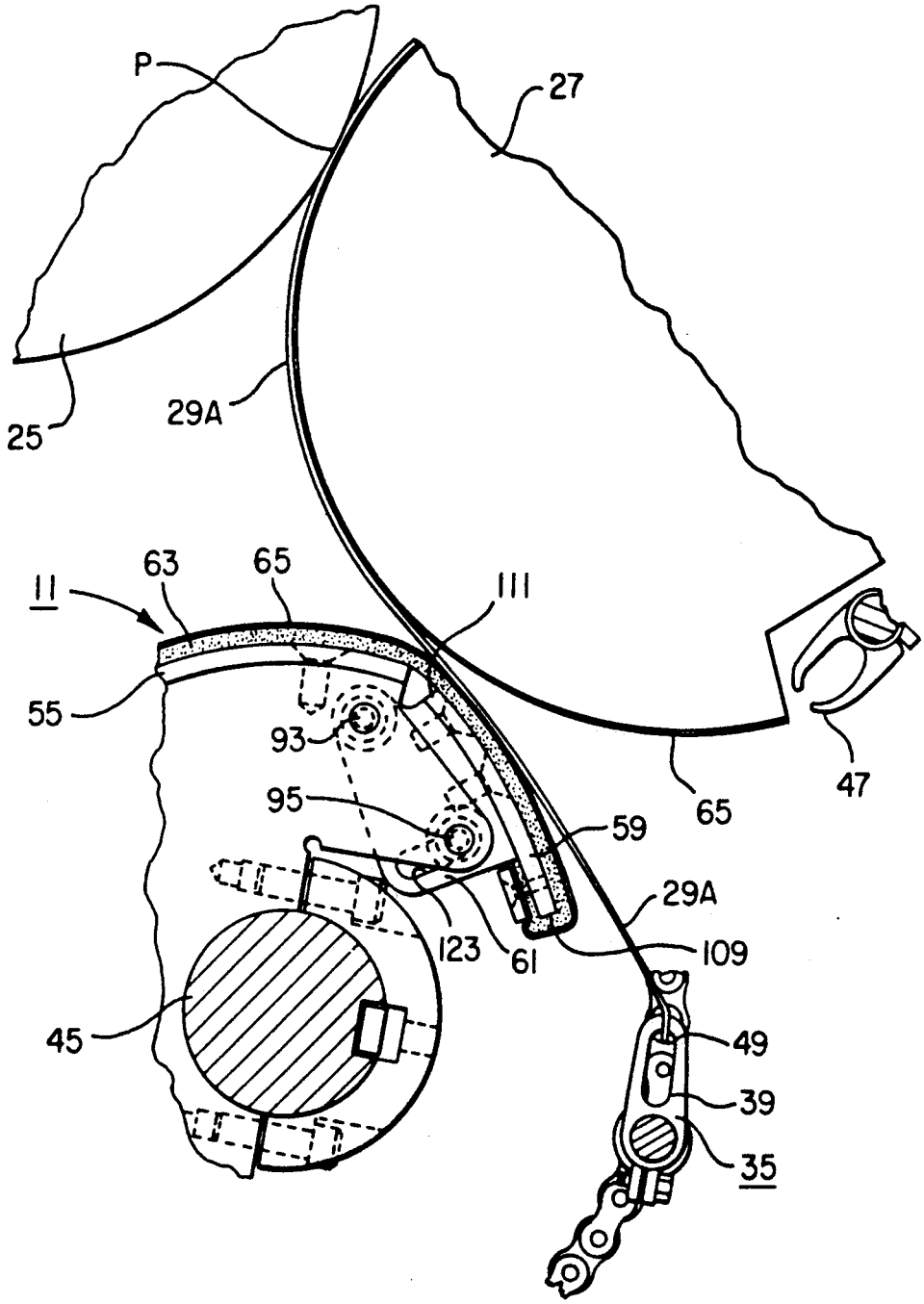
FIG. 1*a* shows the press of FIG. 1, wherein the leading edge wall is in the innermost position and the press has a long sheet of paper.

For a long sheet 29A, as shown in FIG. 1A, the trailing edge portion 51 of the sheet is retained for a much longer period of time. The leading edge wall 59 is positioned in its inwardmost position to reduce sheet deformation. As shown in FIG. 1A, the inwardmost position of the leading edge wall 59 greatly reduces the deformation of the sheet 29A, which reduces the amount of pressure of the sheet against the impression cylinder 27 and the delivery apparatus 11, which in turn reduces marring of the sheet. As the gripper bar 35 rotates clockwise around the shaft 45 toward the exit stack 33, the delivery apparatus will deform the sheet somewhat. But, the pressure of the sheet 29A outside surface of the delivery apparatus, distributing the pressure over the larger area. As the gripper bar 35 continues to move toward the exit stack 33, the grippers 39 will pull the trailing edge 51 of the sheet free from the pinch point P.

The length of the leading edge wall 59, as measured from the trailing edge 111 to the leading edge 109 ideally should be made as large as possible to allow an operator to maximize the reduction of sheet deformation by shortening the sheet path to a maximum extent. This length is limited by the shaft 45 however, which becomes an obstacle to inward movement if the leading edge wall is made too long.

The press operator may take the relative positions between the blanket cylinder 25, the impression cylinder 27, and the delivery apparatus 11 into consideration when adjusting the position of the leading edge wall 59. In FIG. 1, imaginary lines through points X and Y and through Y and Z, which points are the respective axes of rotation, describe an angle that is about 90 degrees. In some taller presses, the blanket cylinder 25 is located physically higher with respect to the delivery apparatus 11, thus making the angle XYZ greater than 90 degrees. The practical consequence of this larger angle is that the pinch point P between the blanket and impression cylinders is raised, wherein the trailing edge portion 51 of the sheet is released earlier in time than for the press of FIG. 1. Thus, in a taller press, a larger sheet may be released earlier from the pinch point, wherein the leading edge wall 59 can be positioned slightly more outwardly than for a shorter press.

The foam layer 63 on the delivery apparatus further acts to reduce the pressure between the sheet 29 and the delivery apparatus 11 by providing some compressibility to the delivery apparatus outside surface. The foam will compress under pressure from the sheet.

The glass-beaded film 65 enhances the non-marring capabilities of the delivery apparatus. The glass-beaded film 65 provides a somewhat roughened surface to contact the wet ink on the sheet. The roughened surface has rounded projections in the form of the glass spheres 127. The voids between the glass spheres receives some of the wet ink. The film can be cleaned using commercially available solvents which are normally used to clean the ink from printing presses. The glass-beaded film 65 can be easily replaced as needed. The old film is simply peeled off and new film is glued back on. The foam 63 can also be replaced as required.

The impression cylinder 27 is also provided with a covering of the glass-beaded film 65. In perfecting presses, after the sheet has gone through the transfer cylinder arrangement 31 (see FIG. 7), the sheet has wet ink against subsequent impression cylinders. The force of the blanket cylinder 25 forces the sheet against the impression cylinder 27; the wet ink acts as a lubricant and causes the sheet to move or jiggle when being printed on by the blanket cylinder. This movement destroys the registry of the press. Registry is important for multicolored printing and requires the sheet to be precisely positioned to allow for accurate inking. Use of the glass-beaded film 65 on impression cylinders improves the registry of the press when wet ink is against the respective impression cylinder and minimizes marring in the wet ink.

Figure 6:
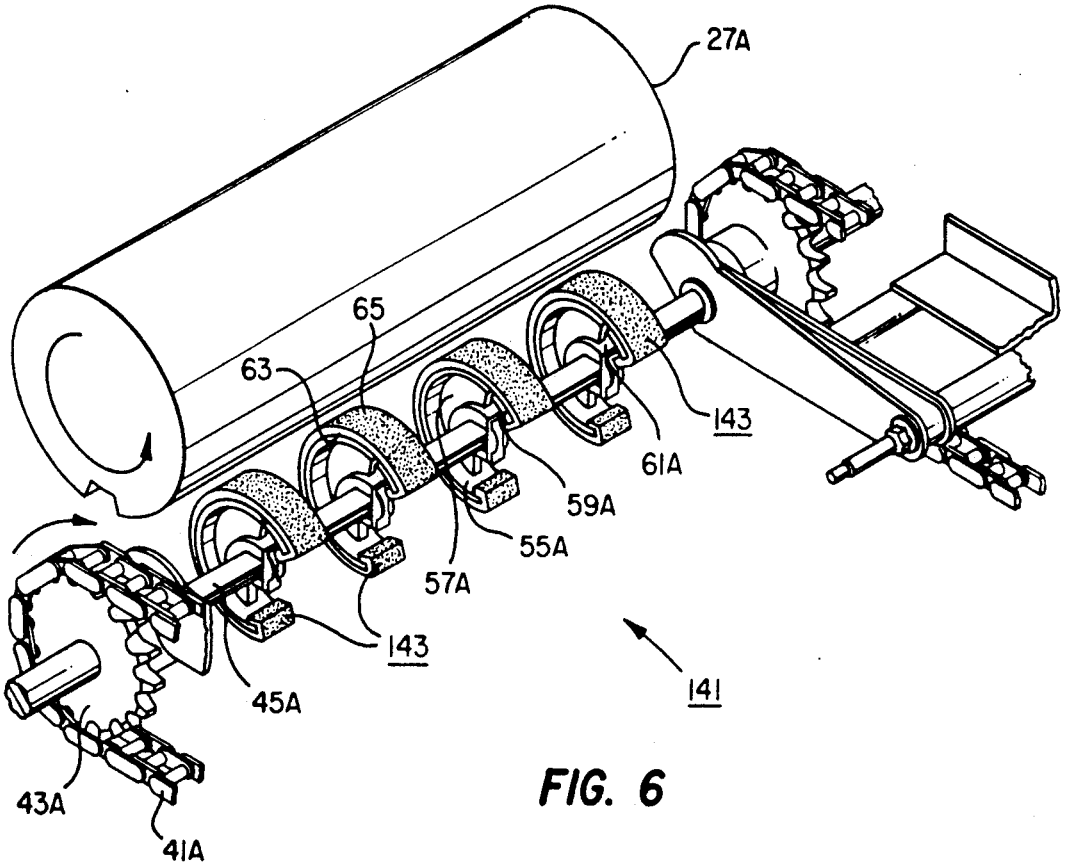
FIG. 6 is a schematic isometric view of the delivery end of a printing press, showing a delivery apparatus in accordance with another embodiment.

In FIG. 6, there is shown a delivery apparatus 141 in accordance with another embodiment. The delivery apparatus includes plural segments 143 mounted onto the shaft 45A in a spaced apart fashion. Instead of one delivery apparatus 11 that extends to both sprockets 43A, the segments 143 are narrow, being separated from one another by spaces. Each segment 143 is similar to the delivery apparatus 11 of FIGS. 1 and 2. Each segment has a main wall 55A, a support member 57A, a leading edge wall 59A, and a leading edge wall support member 61A. The leading edge walls 59A of the segments 143 can be pivoted between an outwardmost position and an inwardmost position. The respective leading edge walls 59A are individually pivoted to the desired position. The segments 143 can be positioned along the shaft 45 to those areas of the sheet path requiring support of the sheet. A layer of foam 63 and glass-beaded film 65 are provided on each segment 143.

Figure 3:
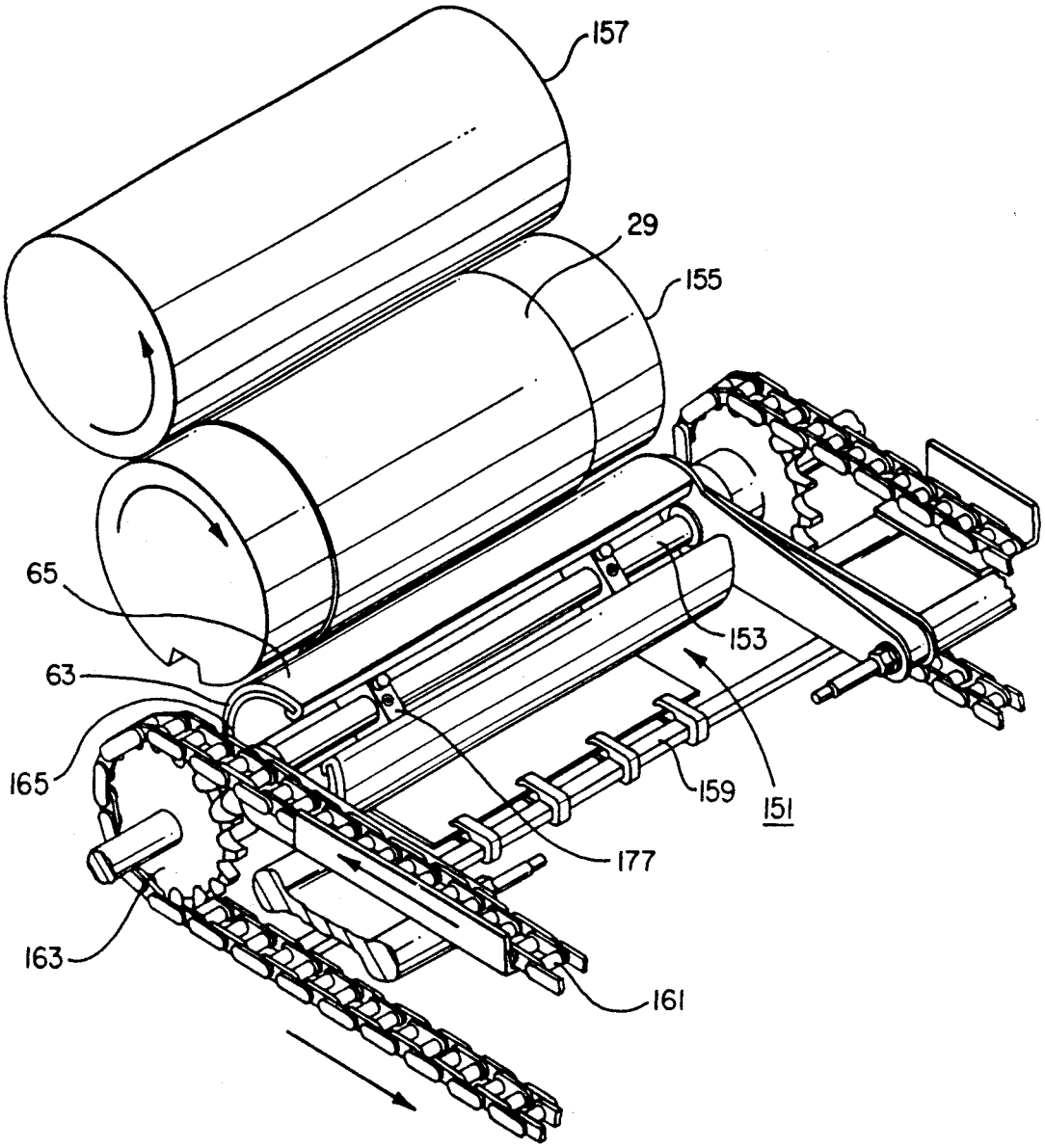
FIG. 3 is a schematic isometric view of the delivery end of a small printing press, showing a delivery apparatus, in accordance with another embodiment.
Figure 4:
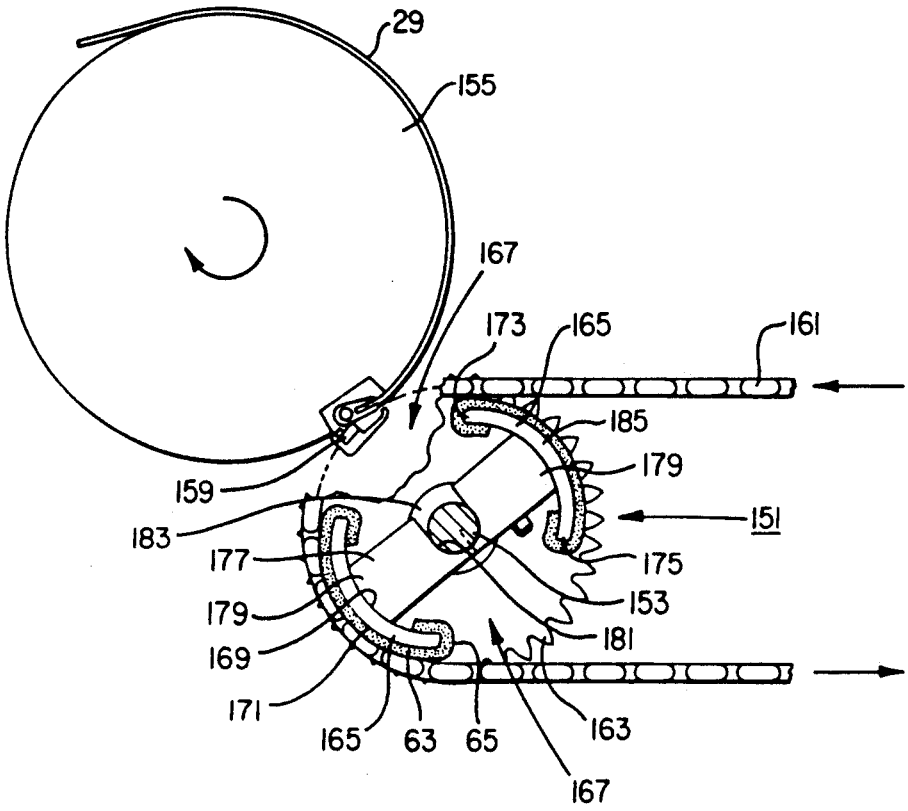
FIG. 4 is a schematic end view of the delivery apparatus of FIG. 3.

Referring to FIGS. 3 and 4, a delivery apparatus 151 in accordance with another embodiment will be described. The delivery apparatus 151 has at least one leading edge 173 that is fixed in a radially inward position. The wall 165 tapers from the leading edge to the central portion of the wall to shorten the sheet path around the shaft 153. The delivery apparatus 151 is useful for small sheet-fed offset lithographic printing presses where, for space limitations, the diameter of the delivery apparatus must be smaller than the diameter of the final impression cylinder. This is due to the gripper bar sprocket shaft 153 being positioned close in to the impression cylinder 155.

The small press is similar to the larger press shown in FIGS. 1 and 2, and has a blanket cylinder 157 and an impression cylinder 155. Plural gripper bars 159 are coupled to the chains 161 in an orientation which is transverse to the direction of sheet travel. The chains 161 are mounted on sprockets 163 which in turn are mounted onto the shaft 153. The diameter of the sprockets 163 is one-half of the diameter of the impression cylinder 155. Therefore, the shaft 153 is positioned close to the outside surface of the impression cylinder 155.

Because of the close position of the shaft 153 to the impression cylinder 155, the delivery apparatus 151 must have a smaller diameter than the impression cylinder 155. The delivery apparatus 151 has two main walls 165 that each extend between first and second ends. The delivery apparatus 151 is provided with two gaps 167 between the main walls 165 that receive the gripper bars 159. In the preferred embodiment, two gaps 167 are provided instead of just a single gap to ensure that the gripper bars are always received by a gap. Thus, successive gripper bars are received by alternating gaps 167. However, if a press and the gripper bars would allow it, the delivery apparatus could be made with just one gap, as described above with reference to FIGS. 1 and 2.

The main walls 165 which are substantially similar to each other, are arcuate, having the same radius. The main walls 165 have inside and outside surfaces 169, 171 and leading and trailing edges 173, 175. Plural support bars 177 couple the main walls 165 together. The ends 179 of the support bars 177 contact the inside surfaces 169 of the respective main walls 165 in such a manner as to be centered between the respective edges 173, 175. The support bars have respective notches 181 for receiving the shaft 153, and respective locking members 183 for locking the shaft in the notches 181.

The length of the support bars 177 as measured between their ends 179, is greater than twice the radius of the main walls 165. Thus, the main walls 165 are mounted with respect to each other such that the distance between their centers 185 is greater than twice their radius. This effectively causes the edges 173, 175 to be positioned radially inward from the centers 185 of the main walls 165. For example, in the preferred embodiment, the main walls 165 are cut from a three and one-half inch outside diameter tube and mounted onto support bars 177 which are four inches in length. At the center 185 of each main wall 165, the inside surface 169 of the main wall is two inches from the center line of the shaft 153. At the edges 173, 175 of each main wall 165, the inside surface 169 is less than two inches from the center line of the shaft.

The main walls 165 are each covered by a layer of foam 63 and glass-beaded film 65, which are glued on using a suitable adhesive.

The delivery apparatus 151 is mounted onto the shaft 153 such that the gripper bars 159 are received by the gaps 167. The gripper bar 159 pulls the sheet 29 around the shaft 153 to the exit stack. As the sheet 29 moves off of the impression cylinder 155, wet ink is against the delivery apparatus 151. The leading edge 173 of the main wall 165 that first contacts the sheet is located radially inward, thus shortening the sheet path and reducing pressure between the sheet and the main wall. The sheet is transferred to the exit stack by the respective gripper bar, with no marring. The foam 63 and the glass-beaded film 65 act to reduce marring of the wet ink as described above.

The foregoing disclosure and the showings made in the drawings are merely illustrative of the principles of this invention and are not to be interpreted in a limiting sense.

We claim:

1. A delivery apparatus for use in a sheet-fed printing press, said printing press having inking means for providing an application of ink to a sheet, and having gripper means for gripping a leading edge of said sheet as said sheet exits from said inking means, comprising:

a) main wall means having first and second ends and a central axis extending between said ends, said main wall means being arcuate;

b) said main wall means having a gap extending between said first and second ends, said gap forming leading and trailing edges on said main wall means;

c) leading edge wall means having a trailing edge and a leading edge, said leading edge wall means being located in said gap and being moveably coupled to said main wall means such that said trailing edge of said leading edge wall means is adjacent to said leading edge of said main wall means, said leading edge wall means forming a smaller gap between said leading edge of said leading edge wall means and said trailing edge of said main wall means;

d) said main wall means and said leading edge wall means having respective outside surface portions that form an outside surface, said outside surface having a myriad of minute projections projecting radially outward, said projections having rounded outer ends;

e) said leading edge wall means being movable between innermost and outermost positions, such that with said leading edge wall means being in said outermost position said leading edge of said leading edge wall means is further away from said central axis than said leading edge of said leading edge wall means when said leading edge wall means is in said innermost position;

f) said main wall means being adapted to be rotatably mounted to said press adjacent to the exit of said inking means, said smaller gap being adapted to receive said gripper means when said gripper means grips the leading edge of said sheet, whereby said leading edge wall means is adapted to contact the portion of said sheet adjacent to said sheet leading edge.

2. The delivery apparatus of claim 1 wherein:

a) said main wall means and said leading edge wall means further comprise a layer of flexible and resilient foam material;

b) said outer surface being provided by a layer of film means, said film means comprising a substrate bonded to said foam material and a myriad of minute particles bonded to said substrate with an oil resistive adhesive, said particles being spherical in shape and of uniform size.

3. The delivery apparatus of claim 1 wherein said leading edge wall means is pivotally coupled to said main wall means at a point located near said trailing edge of said leading edge wall means such that said leading edge of said leading edge wall pivots radially in and out.

4. The delivery apparatus of claim 2 wherein said leading edge wall means is pivotally coupled to said main wall means at a point located near said trailing edge of said leading edge wall means such that said leading edge of said leading edge wall pivots radially in and out.

5. The delivery apparatus of claim 1 wherein said outer surface is provided by a film means, said film means comprising a substrate and a myriad of minute particles bonded to said substrate with an oil resistive adhesive, said particles being spherical in shape and of uniform size.

6. A delivery apparatus for use in a sheet-fed printing press, said printing press having inking means for providing an application of ink to a sheet, and having gripper means for gripping a leading edge of said sheet as said sheet exits from said inking means, comprising:

a) main wall means having first and second ends and a central axis extending between said ends, said main wall means being tubular having an interior cavity;

b) said main wall means having a gap extending between said first and second ends, said gap forming leading and trailing edges on said main wall means, said gap allowing access to said interior cavity;

c) support means for supporting said main wall means, said support means being located in said cavity and coupled to said main wall means, said support means being adapted to be rotatably mounted to said press adjacent to the exit of said inking means;

d) leading edge wall means having a leading edge and a trailing edge, said leading edge wall means being located in said gap and being coupled with said main wall means such that said trailing edge of said leading edge wall means is adjacent to said leading edge of said main wall means, said leading edge wall means forming a smaller gap between said leading edge of said leading edge wall means and said trailing edge of said main wall means;

e) said leading edge wall means being pivotable with respect to said main wall means such that said leading edge of said leading edge wall means pivots between innermost and outermost positions, retaining means for retaining the position of said leading edge wall means, said retaining means allowing for the pivoting adjustment of said leading edge wall means;

f) said main wall means and said leading edge wall means having respective outside surface portions that form an outside surface, said outside surface having a myriad of minute projections projecting radially outward, said projections having rounded outer ends;

g) said smaller gap being adapted to receive said gripper means when said gripper means grips the leading edge of said sheet when said support means is rotatably mounted to said press.

7. The delivery apparatus of claim 6 wherein:

a) said main wall means and said leading edge wall means further comprise a layer of flexible and resilient foam material;

b) said outer surface being provided by a layer of film means, said film means comprising a substrate bonded to said foam material and a myriad of minute glass particles bonded to said substrate with an oil resistive adhesive, said glass particles being spherical in shape and of uniform size.

8. A delivery apparatus for use in a sheet-fed printing press, said printing press having inking means for providing an application of ink to a sheet, and having gripper means for gripping a leading edge of said sheet as said sheet exits from said inking means, comprising:

(a) plural segments adapted to be rotatably mounted to said press adjacent to the exit of said inking means such that said segments are located along a line oriented transversely to said leading edge of said sheet;

(b) each of said segments having a main wall means, said main wall means having a leading edge and a trailing edge and a gap formed between said leading and trailing edges;

c) each of said segments having a leading edge wall means having a trailing edge and a leading edge, said leading edge wall means being located in said gap and being moveably coupled to said main wall means such that said trailing edge of said leading edge wall means is adjacent to said leading edge of said main wall means, said leading edge wall means forming a smaller gap between said leading edge of said leading edge wall means and said trailing edge of said main wall means;

d) for each of said segments said main wall means and said leading edge wall means having respective outside surface portions that form an outside surface, said outside surface being arcuate from said trailing edge of said main wall means to said leading edge of said leading edge wall means, said outside surface having a myriad of minute projections projecting radially outward, said projections having rounded outer ends;

e) for each of said segments said leading edge wall means being movable between innermost and outermost positions, such that with said leading edge wall means being in said outermost position said leading edge of said leading edge wall means is further away from said central axis than said leading edge of said leading edge wall means when said leading edge wall means is in said innermost position;

f) for each of said segments said main wall means being adapted to be rotatably mounted to said press adjacent to the exit of said inking means, said smaller gap being adapted to receive said gripper means when said gripper means grips the leading edge of said sheet, whereby said leading edge wall means is adapted to contact the portion of said sheet adjacent to said sheet leading edge.

9. The delivery apparatus of claim 8 wherein:

a) for each of said segments said main wall means and said leading edge wall means further comprise a layer of flexible and resilient foam material;

b) said outer surface on each of said segments being provided by a layer of film means, said film means comprising a substrate bonded to said foam material and a myriad of minute particles bonded to said substrate with an oil resistive adhesive, said particles being spherical in shape and uniform in size.

10. The delivery apparatus of claim 9 wherein for each of said segments said leading edge wall means is pivotally coupled to said main wall means at a point located near said trailing edge of said leading edge wall means such that said leading edge of said leading edge wall means pivots radially in and out.

11. A delivery apparatus for use in a sheet-fed printing press, said printing press having inking means for providing an application of ink to a sheet, and having gripper means for gripping a leading edge of said sheet as said sheet exits from said inking means, comprising:

(a) wall means having first and second ends and a central axis extending between said ends, said wall means being arcuate;

(b) said wall means having a gap extending between said first and second ends, said wall means having a leading edge and a trailing edge and a central portion located between said leading and trailing edges, said gap allowing access to a cavity inside of said wall means;

(c) support means for supporting said wall means, said support means being located in said cavity and coupled to said wall means such that said leading edge of said wall means is located closer to said central axis than is said central portion, said support means being adapted to be rotatably mounted to said press adjacent to the exit of said inking means;

(d) said wall means having an outside surface, said outside surface having a myriad of minute projections projecting radially outward, said projections having rounded outer ends;

(e) said gap being adapted to receive said gripper means when said gripper means grips the leading edge of said sheet when said delivery apparatus is mounted to said press;

(f) said wall means further comprising a layer of flexible and resilient foam material;

(g) said outer surface being provided by a layer of film means, said film means comprising a substrate bonded to said foam material and a myriad of minute particles bonded to said substrate with an oil resistive adhesive, said particles being spherical in shape and uniform in size;

(h) said gap being a first gap, said wall means having a second gap, said gaps dividing said wall means into two portions with each wall means portion having a leading edge and a trailing edge and a central portion, said respective leading edges being located closer to said central axis than said respective central portions;

(i) each of said wall means portions has a first radius, said support means has ends that couple to said wall means portions, said support means has a second radius as measured from the central axis to one of said ends of said support means, said second radius being greater than said first radius.

12. A sheet-fed printing press, comprising:

(a) inking means for providing an application of ink to a sheet of paper;

(b) gripper means for gripping a leading edge of said sheet as said sheet exits from said inking means, said gripper means rotating about a shaft positioned in proximity with the exit of said inking means;

(c) wall means having first and second ends and a central axis extending between said ends, said wall means being arcuate;

(d) said wall means having first and second gaps extending between said first and second ends, said gaps dividing said wall means into two portions, with each wall means portion having a leading edge and a trailing edge and a central portion located between said leading and trailing edges, said gaps allowing access to a cavity inside of said wall means, each of said wall means portions having a first radius;

(e) support means for supporting said wall means portions, said support means being located in said cavity and coupled to said wall means portions, said support means having a length extending between said wall means portions, said support means length being greater than twice the first radius of said wall means portions such that said leading edges of said wall means portions are located closer to said central axis than are said respective central portions, said support means being coupled to said shaft so as to rotate with said shaft such that said gaps receive said gripper means when said gripper means grips the leading edge of said sheet;

(f) said wall means portions having respective outside surfaces, said outside surfaces having a myriad minute projections projecting radially outward, said projections having rounded outer ends.

13. The delivery apparatus of claim 8 wherein each of said outside surfaces is provided by a film means, said film means comprising a substrate and a myriad of minute particles bonded to said substrate with an oil resistive adhesive, said particles being spherical in shape and of uniform size.

14. A delivery apparatus for use in a sheet fed printing press, said printing press having inking means for providing an application of ink to a sheet, and having gripper means for gripping a leading edge of said sheet as said sheet exits from said inking means, comprising:

(a) wall means having first and second ends and a central axis extending between said ends, said wall means being generally arcuate;

(b) said wall means having a leading edge portion, said wall means having a gap that extends between said first and second ends, said gap being between said leading edge portion and a trailing edge of said wall means, said gap being adapted to receive said gripper means as said gripper means grips the leading edge of said sheet when said delivery apparatus is mounted to said press;

(c) said leading edge portion of said wall means being positioned closer to said central axis than a non-leading edge portion of said wall means;

(d) said wall means having an outside surface that is adapted to contact said sheet when said sheet is being pulled by said gripper means, said outside surface being ink resistive wherein marring of wet ink on said sheet, which wet ink is in contact with said outside surface, is reduced;

(e) said leading edge portion being movable with respect to the non-leading edge portion of said wall means, said leading edge portion being movable between innermost and outermost positions such that when said leading edge portion is in said outermost position said leading edge portion is further away from said central axis than when said leading edge portion is in said innermost position.

15. The delivery apparatus of claim 14 wherein said outside surface is provided by replaceable film means.

16. The delivery apparatus of claim 14 wherein said outside surface is provided by replaceable film means, said wall means further comprising a layer of flexible and resilient foam material, said film means being coupled to said foam material, said foam material being coupled to a support wall of said wall means.

* * * * *